United States Patent [19]

Strate

[11] 4,258,972

[45] Mar. 31, 1981

[54] ELECTRICAL SOCKET CONNECTOR

[75] Inventor: Klaus Strate, Detmold, Fed. Rep. of Germany

[73] Assignee: C. A. Weidmuller KG, Detmold, Fed. Rep. of Germany

[21] Appl. No.: 962,418

[22] Filed: Nov. 20, 1978

[30] Foreign Application Priority Data

Nov. 29, 1977 [DE] Fed. Rep. of Germany ..... 2753172

[51] Int. Cl.[3] ..... H01R 13/42

[52] U.S. Cl. ..... 339/59 R; 339/272 R

[58] Field of Search ..... 339/59, 220, 272 R, 339/272 A, 272 UC

[56] References Cited

U.S. PATENT DOCUMENTS

| | | | |
|---|---|---|---|
| 2,707,774 | 5/1955 | Keller | 339/272 A |
| 3,181,113 | 4/1965 | Esser | 339/272 R |
| 3,781,760 | 12/1973 | Mancini et al. | 339/59 M |
| 3,944,312 | 3/1976 | Koenig | 339/59 R |

FOREIGN PATENT DOCUMENTS

| | | | |
|---|---|---|---|
| 1790043 | 12/1971 | Fed. Rep. of Germany | 339/59 R |
| 1020314 | 11/1952 | France | 339/272 R |
| 1490689 | 6/1967 | France | 339/272 R |

*Primary Examiner*—Joseph H. McGlynn

*Attorney, Agent, or Firm*—Pollock, Vande Sande & Priddy

[57] ABSTRACT

An electrical connector has a screw-clamping sleeve electrically connected to and aligned with a plug socket in an injection-molded plastic housing. To prevent a conductor inserted in the clamping sleeve from entering the socket, the housing contains an integrally molded partition which in the as-molded state extends obliquely into the recess of the housing that will accommodate the clamping sleeve. In this condition the socket can be inserted past the partition into a corresponding aperture, but the clamping sleeve when inserted bends the partition to a position between the clamping sleeve and the socket.

4 Claims, 4 Drawing Figures

ELECTRICAL SOCKET CONNECTOR

Figure 1:
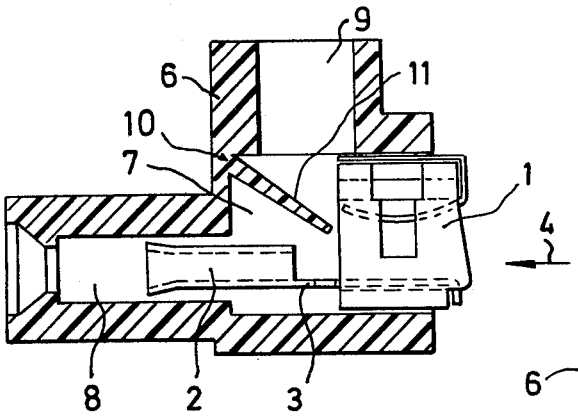

The invention relates to an electrical connector with a screw connector comprising a screw and a terminal member, and with a socket which is electrically conductively connected to the terminal member, the internal space of the socket being situated in alignment with the internal space of the terminal member and with the insertion direction of the electric conductor which is to be secured in the terminal member, and being perpendicular to the screwing direction of the screw, and the connector having a plastic housing provided with correspondingly branched apertures for the insertion of the terminal member together with the insertion bush and the screw.

In commercial plug connectors of this kind, the screw connector and the socket are fitted by inserting the terminal member, to whose bottom region the socket is connected by means of a tag, into a housing recess which is open on one side and accommodates the terminal member, and an aperture which branches from the bottom region of the aforementioned recess to accommodate the socket. Perpendicular to the said aperture for the socket, the aperture for the insertion of the screw also branches from the recess for the terminal member, and the screw is accessible by means of a screwdriver through the last-mentioned aperture. The aperture for the socket is open to the exterior of the housing so that a plug pin or blade can be inserted therein.

It is a disadvantage of such connectors that the internal space of the socket remains open, through its rear region, to the internal space of the terminal member. Unless care is taken when the conductor to be connected is inserted into the internal space of the terminal member, the electric conductor may accidentally be inserted so far that it also enters the socket. The conductor will then be secured in this position by means of the clamping screw in the terminal member. If a plug pin is subsequently inserted from the front into the socket to establish a connection between electrical conductors, this cannot be done with reliability because the socket is wholly or partially blocked by the electric conductor which has been inserted too far.

It would be feasible to insert some form of separator, for example a separator plate or the like between the rear end of the socket and the internal space of the terminal member, but in view of the small size of the components of such connectors such a special part would substantially complicate the assembly of the connectors.

It is therefore the object of the present invention to provide a connector of the kind described hereinbefore which reliably prevents the accidental insertion of an electrical conductor from the rear into the socket, while maintaining simplicity of assembly.

According to the invention there is provided an electrical socket connector comprising an injection-molded insulating plastic housing, a first aperture in the housing, a terminal member in the first aperture and adapted to receive an inserted electrical conductor, a clamping screw for clamping an inserted conductor in the terminal member, a second aperture in the housing forming a continuation of the first aperture, a socket member in the second aperture for receiving a plug member and electrically connected to the terminal member, the socket member and terminal member having mutually aligned internal spaces for respectively receiving said plug member and conductor, a third aperture in the housing extending laterally to the first aperture and accommodating the screw, and a flexible tongue molded integrally with the housing and extending in the first aperture from a corner of the first aperture between the second and third apertures, the tongue when in an unstressed state extending obliquely into the first aperture, the tongue being trapped and bent by the terminal member to a position in which the tongue forms a partition between the said internal spaces of the socket and the terminal member.

The invention also provides an electrical socket connector having a screw connector comprising a clamping screw and a terminal member, a socket which is electrically conductively connected to the terminal member, the socket having a bore situated in alignment with the internal space of the terminal member and with the insertion direction of an electric conductor to be secured in the terminal member, the said bore being perpendicular to the screwing direction of the screw, and a housing of plastic material provided with correspondingly branched apertures for the insertion of the terminal member together with the socket and the screw, characterized in that the housing aperture for the terminal member, in the corner of said aperture between the apertures for the socket and the screw, a partition which, prior to installation of the socket and terminal member, extends downwardly at an angle into the aperture for the terminal member, is integrally injection-molded in the housing.

When the terminal member together with the socket is inserted into the housing in the usual manner, the partition tongue, extending downwardly at an angle, will allow the socket to pass beneath it, but the tongue will then be pivoted by the terminal member against the resilience of the plastic material forming it so as to be positioned substantially in front of the opening of the aperture for the socket, whereby the rear open end of the socket is blocked by the bottom region of the partition opposite the internal space of the terminal member, so that an electric conductor inserted into the internal space of the terminal member can never accidentally be inserted as far as the socket. Assembly is not more difficult than the assembly of a conventional socket connector, since the partition is automatically pushed into its blocking position when the terminal member and socket are inserted in the housing.

Usually the socket is connected to the terminal member by means of a tag. The partition according to the invention also offers the advantage that it simultaneously prevents the tag and therefore the socket from rotating with respect to the terminal member.

Figure 2:
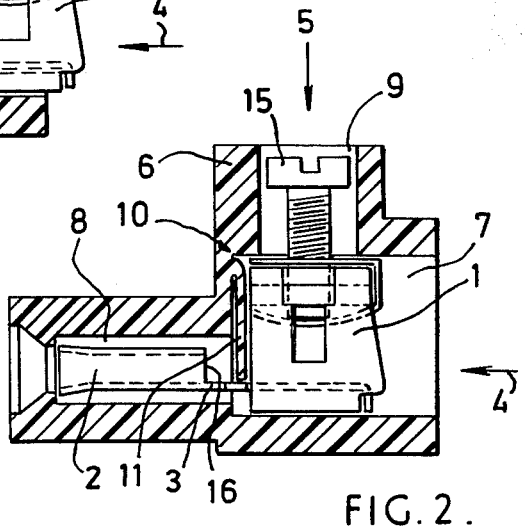
Figure 3:
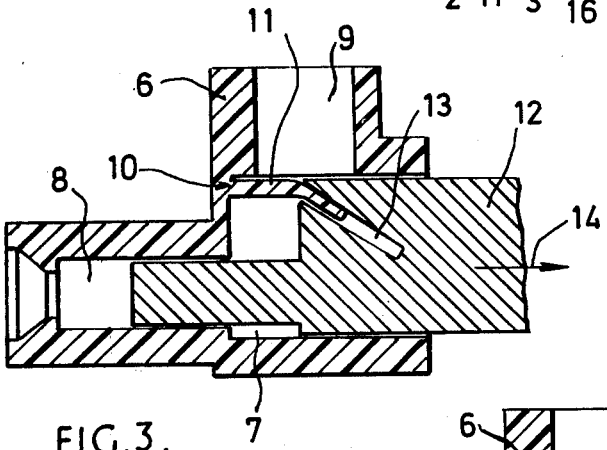
Figure 4:
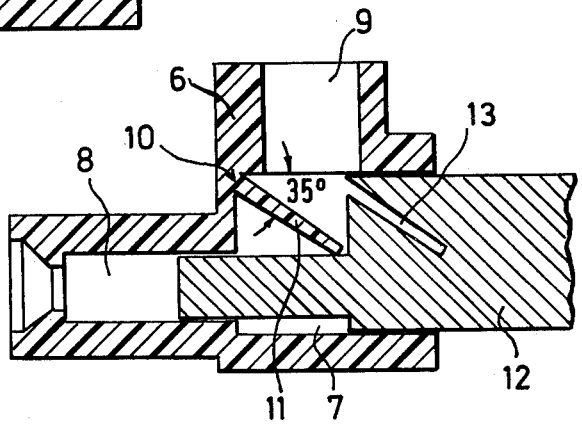

One embodiment of the invention will be explained hereinbelow by reference to the accompanying drawings, in which:

FIG. 1 is a section through a socket connector according to the invention, partly assembled, FIG. 2 is a sectional view of the connector according to FIG. 1, assembled, FIG. 3 is a section through the housing of the connector according to the invention, while being stripped from an injection-molding die, and FIG. 4 is a section similar to FIG. 3, immediately before the completion of stripping.

The illustrated socket connector is provided with a screw connection comprising a terminal sleeve or yoke 1 for receiving an electrical conductor, and is also provided with a metal socket 2 to receive a plug pin or blade. The socket 2 is electrically conductively connected by means of a tag 3 to the terminal member 1. The bore of the socket 2 is in flush alignment with the interior space of the terminal member and with the insertion direction 4 of the electric conductor which is to be secured in the terminal member 1. The latter has a clamping screw 15 for clamping the conductor 4. The bore of the socket 2 is perpendicular to the screwing direction 5 of the screw. The plug connector has an insulating plastic housing 6 provided with a recess 7 which is open to the rear to accommodate the terminal member 1 and to receive the conductor. Extending as a continuation of this recess 7 is a passage 8 to accommodate the socket 2, and perpendicular to the recess 7 and passage 8 is a hole 9 for accommodating the screw 15.

A partition 11 is integrally injection-molded in the recess 7, in the corner 10 between the passage 8 and hole 9, and extends downwardly into the recess 7, prior to installation of the terminal member 1 and of the socket 2, as shown in FIG. 1. In the unstressed position prior to installation of the terminal member and the socket, the partition 11 is oblique and does not cover the open end of the passage 8 merging into the recess 7.

The terminal member 1 and the socket 2 are installed in simple manner, by the terminal member 1 together with the socket 2 being inserted from the rear into the recess 7, the arrow 4 indicating the installation direction. The socket 2 can pass beneath the sloping partition 11 and can readily be introduced into the passage 8. However, in the further course of the installation procedure, the partition 11 is pivoted by the terminal member 1, which is deeper than the socket, against the resilience of its material, from its sloping position, until it lies against the boundary wall of the recess 7 into which the passage 8 opens. As can be seen by reference to FIG. 2, the bent partition 11 will thus be held in front of the end of the passage 8 where the passage 8 opens into the recess 7, and thus will block the open rear end 16 of the socket 2 against entry of an electrical conductor inserted into the interior space of the terminal member 1. By blocking the tag 3, which is substantially flat, the partition 11 in this position can also prevent the socket 2 rotating with respect to the terminal member 1.

It should be noted that not only single-pole but also muti-pole socket connectors and connector strips can be provided with a corresponding partition 11.

The production of the integral partition will now be briefly described.

As can be seen by reference to FIGS. 3 and 4, a sloping channel 13, into which the plastic material can flow during the injection molding of the housing 6, is provided in the production die 12 for the housing 6, to produce a tongue forming the integrally injection-molded partition 11. It has surprisingly been found that the partition 11 does not tear off during stripping from the mold (FIG. 3). It has also been surprisingly found that immediately after the stripping operation, and owing to the elasticity of the plastic material in the freshly injection-molded state, the partition 11 returns to its original sloping position (FIG. 4). The mold stripping operation is somewhat facilitated by imparting to the partition 11 a shape which in longitudinal section converges in a slight taper to the free end. It has been found advantageous to provide an angle of slope of approximately 35° with respect to the mold stripping direction of the die 12 as indicated by the arrow 14.

I claim:

1. An electrical socket connector having a screw connector comprising (a) a clamping screw;

(b) a terminal member having an internal space;

(c) a socket electrically conductively connected to said terminal member, said socket having a bore situated in alignment with said internal space of said terminal member and with the insertion direction of an electric conductor to be secured in said terminal member, said bore being substantially perpendicular to the screwing direction of said screw;

(d) a housing of plastic material provided with correspondingly branched apertures for the insertion of said terminal member together with said socket and said screw; and (e) a partition which, prior to installation of said socket and said terminal member, extends downwardly at an angle from the corner between the apertures for said socket and said screw into the aperture for said terminal member and away from said socket, said partition being integrally injection-molded in said housing.

2. An electrical socket connector comprising (a) an injection-molded insulating plastic housing;

(b) a first aperture in said housing;

(c) a terminal member in said first aperture adapted to receive an inserted electrical conductor;

(d) a clamping screw for clamping an inserted conductor in said terminal member;

(e) a second aperture in said housing forming a continuation of said first aperture;

(f) a socket member in said second aperture for receiving a plug member and electrically connected to said terminal member, said socket member and terminal member having mutually aligned internal spaces for respectively receiving said plug member and conductor;

(g) a third aperture in said housing extending laterally to said first aperture and accommodating said clamping screw; and (h) a flexible tongue molded integrally with said housing and extending in said first aperture from a corner of said first aperture between said second and third apertures, said tongue when in an unstressed state extending obliquely into said first aperture and away from said second aperture, said tongue being trapped and bent by insertion of said terminal member to a position in which said tongue is substantially parallel to the leading face of said terminal member so as to form a partition between said internal spaces of said socket and said terminal member;

(i) whereby overinsertion of a said conductor into said second aperture is blocked by said tongue.

3. A connector according to claim 2, wherein, prior to installation of said terminal member, said partition is inclined at an angle of approximately 35° to the mold stripping direction of a die used for producing said housing.

4. A connector according to claim 2, wherein said partition, in longitudinal section, converges with a slight taper towards its free end.

* * * * *